US008806704B2

(12) United States Patent
Wahl et al.

(10) Patent No.: US 8,806,704 B2
(45) Date of Patent: Aug. 19, 2014

(54) AUTOMOTIVE SWEEPER

(75) Inventors: Joachim Wahl, Spiegelberg-Jux (DE); Bernd Haberl, Weissach im Tal (DE); Uwe Weller, Allmersbach im Tal (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 367 days.

(21) Appl. No.: 13/223,353

(22) Filed: Sep. 1, 2011

(65) Prior Publication Data

US 2012/0060319 A1 Mar. 15, 2012

Related U.S. Application Data

(63) Continuation of application No. PCT/EP2009/001996, filed on Mar. 17, 2009.

(51) Int. Cl.
*A47L 11/24* (2006.01)

(52) U.S. Cl.
USPC ..... 15/340.3; 15/349

(58) Field of Classification Search
USPC ..... 15/322, 349, 340.3, 340.4, 348, 83
See application file for complete search history.

(56) References Cited

U.S. PATENT DOCUMENTS

| | | | |
|---|---|---|---|
| 1,452,307 | A | 4/1923 | Martin |
| 1,546,071 | A | 7/1925 | Harris |
| 2,558,623 | A | 6/1951 | Mott |
| 2,672,634 | A | 3/1954 | Burnham |
| 2,708,280 | A | 5/1955 | Antos et al. |
| 2,917,761 | A | 12/1959 | Burgdorff |
| 3,292,195 | A | 12/1966 | Schmidt et al. |
| 3,316,578 | A | 5/1967 | Tamny |
| 3,353,199 | A | 11/1967 | Palmiter et al. |
| 3,401,416 | A | 9/1968 | Ziegler |
| 3,459,109 | A | 8/1969 | Ingleright |
| 3,634,904 | A | 1/1972 | Larsen |
| D228,362 | S | 9/1973 | Krier et al. |
| 3,790,981 | A | 2/1974 | Young |

(Continued)

FOREIGN PATENT DOCUMENTS

| | | |
|---|---|---|
| DE | 930948 | 7/1955 |
| DE | 8617171 | 11/1986 |

(Continued)

OTHER PUBLICATIONS

Tennant Company brochure entitled 5400 Automatic Scrubber, 2004, 4 pages.

(Continued)

*Primary Examiner* — Dung Van Nguyen
(74) *Attorney, Agent, or Firm* — Lipsitz & McAllister, LLC

(57) ABSTRACT

The invention relates to an automotive sweeper with wheels for traveling along a ground surface and with at least one sweeping brush rotatingly drivable for sweeping the ground surface and with a dirt container adapted to be acted upon with a vacuum by a suction unit via a suction conduit and connected to a suction port via an intake line for the purpose of receiving sweepings. In order to develop the sweeper further in such a manner that it achieves an improved cleaning result with as little use of energy as possible it is suggested in accordance with the invention that the suction conduit be integrated into the dirt container at least in sections, wherein the outlet of the intake line opening into the dirt container is arranged next to at least one inlet area of the suction conduit.

21 Claims, 3 Drawing Sheets

(56) References Cited

U.S. PATENT DOCUMENTS

| | | | | | |
|---|---|---|---|---|---|
| D231,387 | S | | 4/1974 | Krier et al. | |
| 3,942,218 | A | | 3/1976 | Krier et al. | |
| 3,959,010 | A | | 5/1976 | Thompson et al. | |
| 4,183,116 | A | | 1/1980 | Thompson | |
| 4,317,252 | A | | 3/1982 | Knowlton | |
| 4,335,482 | A | | 6/1982 | Jones | |
| 4,364,138 | A | | 12/1982 | Waldhauser et al. | |
| D281,109 | S | | 10/1985 | van Raaij | |
| D281,633 | S | | 12/1985 | Pratt | |
| D281,634 | S | | 12/1985 | Pratt | |
| D291,932 | S | | 9/1987 | Knowlton et al. | |
| 4,754,521 | A | | 7/1988 | Zoni | |
| 4,779,303 | A | * | 10/1988 | Duthie et al. | 15/326 |
| 4,799,282 | A | | 1/1989 | Fischer | |
| 4,903,368 | A | * | 2/1990 | Duthie et al. | 15/339 |
| 5,243,727 | A | | 9/1993 | Tanaka et al. | |
| 5,259,085 | A | | 11/1993 | Marafante et al. | |
| 5,421,053 | A | | 6/1995 | Chodak | |
| 5,715,567 | A | | 2/1998 | Tagliaferri | |
| D391,697 | S | | 3/1998 | Knowlton et al. | |
| 5,771,532 | A | * | 6/1998 | Munnoch | 15/352 |
| 5,991,951 | A | | 11/1999 | Kubo et al. | |
| 6,070,290 | A | * | 6/2000 | Schwarze et al. | 15/340.1 |
| 6,088,873 | A | | 7/2000 | Pacchini et al. | |
| 6,154,920 | A | * | 12/2000 | Petrole et al. | 15/349 |
| 6,163,923 | A | | 12/2000 | Hefter | |
| 6,530,102 | B1 | | 3/2003 | Pierce et al. | |
| 6,675,424 | B2 | | 1/2004 | Smith et al. | |
| 6,836,919 | B2 | | 1/2005 | Shinler | |
| 7,013,527 | B2 | | 3/2006 | Thomas, Sr. et al. | |
| 7,059,004 | B2 | | 6/2006 | Mitchell et al. | |
| 7,441,303 | B2 | | 10/2008 | Adair et al. | |
| 7,587,779 | B2 | | 9/2009 | Walz et al. | |
| 7,765,630 | B2 | | 8/2010 | Flora et al. | |
| D642,343 | S | | 7/2011 | Dammkoehler | |
| 8,136,193 | B2 | | 3/2012 | Larkowski et al. | |
| 8,234,749 | B2 | | 8/2012 | Mitchell et al. | |
| 2002/0138939 | A1 | | 10/2002 | Smith et al. | |
| 2002/0179116 | A1 | | 12/2002 | Shinler | |
| 2003/0000549 | A1 | | 1/2003 | Joynt et al. | |
| 2004/0025270 | A1 | | 2/2004 | Mitchell et al. | |
| 2005/0028316 | A1 | | 2/2005 | Thomas, Sr. et al. | |
| 2005/0246845 | A1 | | 11/2005 | Duncan et al. | |
| 2008/0216259 | A1 | | 9/2008 | Walz et al. | |
| 2010/0197210 | A1 | | 8/2010 | Goldberg et al. | |
| 2010/0325824 | A1 | | 12/2010 | Baum et al. | |

FOREIGN PATENT DOCUMENTS

| | | |
|---|---|---|
| DE | 91 04 224 | 9/1991 |
| DE | 94 09 379 | 8/1994 |
| DE | 44 14 628 | 10/1995 |
| DE | 19522019 | 4/1997 |
| DE | 20112322 | 11/2001 |
| DE | 101 18 500 | 8/2002 |
| DE | 4434520 | 5/2005 |
| DE | 10 2005 018 882 | 11/2006 |
| EP | 0 021 784 | 1/1981 |
| EP | 0251987 | 1/1991 |
| EP | 0487892 | 6/1992 |
| EP | 0 945 551 | 9/1999 |
| EP | 1 061 180 | 12/2000 |
| EP | 1279363 | 1/2003 |
| EP | 1 516 965 | 3/2005 |
| EP | 1714603 | 10/2006 |
| EP | 1 772 563 | 4/2007 |
| EP | 1 772 564 | 5/2008 |
| EP | 1 967 653 | 9/2008 |
| EP | 1 988 214 | 11/2008 |
| FR | 2 901 289 | 11/2007 |
| FR | 2 912 434 | 8/2008 |
| GB | 2 420 813 | 6/2006 |
| JP | 05300860 | 11/1993 |
| JP | 08280592 | 10/1996 |
| JP | 2002065538 | 3/2002 |
| JP | 2006034984 | 2/2006 |
| JP | 20100335773 | 2/2010 |
| WO | 88/09848 | 12/1988 |
| WO | 9842245 | 10/1998 |
| WO | 03053206 | 7/2003 |
| WO | 2009/014511 | 1/2009 |

OTHER PUBLICATIONS

Extract for catalog of Alfred Kaercher GmbH & Co. KG, "Programme 2005", cover, pp. 231-215, 218-219 and last page, (Dec. 2004).

Extract from catalog of Alfred Kaercher GmbH & Co. KG, "Programme 2006" cover, pp. 232-233, 236-237 and last page (Dec. 2005).

Extract from catalog of Alfred Kaercher GmbH & Co. KG, "Programme 2007", cover, pp. 253-257, 261-263 and last page (Jan. 2007).

Extract from catalog of Alfred Kaercher GmbH & Co. KG, "Programme 2008", cover, pp. 269-273, 277-279, 281 and last page (Dec. 2007).

Extract from catalog of Alfred Kaercher GmbH & Co. KG, "Programme 2009 Kaercher Industrial", cover, p. 35 and last page (Mar. 2009).

* cited by examiner

AUTOMOTIVE SWEEPER

This application is a continuation of international application number PCT/EP2009/001996 filed on Mar. 17, 2009.

The present disclosure relates to the subject matter disclosed in international application number PCT/EP2009/001996 of Mar. 17, 2009, which is incorporated herein by reference in its entirety and for all purposes.

BACKGROUND OF THE INVENTION

The invention relates to an automotive sweeper with wheels for traveling along a ground surface and with at least one sweeping brush which can be rotatingly driven for sweeping the ground surface and with a dirt container which is adapted to be acted upon with a vacuum by a suction unit via a suction conduit and which is connected via an intake line to a suction port for the purpose of receiving sweepings.

A ground surface, for example a street, a sidewalk or a parking lot, can be swept by means of such sweepers. The at least one sweeping brush engages on the ground surface to be cleaned and guides the sweepings to a suction port, from which the sweepings are transferred into a dirt container. For this purpose, the dirt container is acted upon with a vacuum by a suction unit so that a suction flow is formed from the suction port to the dirt container and from this to the suction unit. The sweeper is designed to be automotive, for example in the form of a vehicle, wherein the dirt container may be arranged in the rearward area of the vehicle and the vehicle may have a driver's cab in the forward area. The intake line which connects the suction port to the dirt container normally opens into the dirt container in the area of a container wall which is to the front in relation to the direction of travel of the sweeper.

Sweepers of the type described at the outset are known from U.S. Pat. No. 4,754,521. In this respect, the suction port is arranged between a steerable front wheel and two non-steerable rear wheels and the intake line runs from the suction port in a vertical direction upwards as far as an opening in the front container wall of the dirt container. In the transition area between the intake line and the dirt container, the suction flow experiences a deflection through 90°. The suction flow extends within the dirt container contrary to the direction of travel of the sweeper towards the back and reaches a filter unit. The suction flow passes from the filter unit into a suction conduit which is designed in the form of a vertical pipe and is arranged centrally in the dirt container in the direction of travel. In order to increase the intake of sweepings from the ground surface to be cleaned, it is suggested in U.S. Pat. No. 4,754,521 to arrange a conveyor belt with carrying bags, via which the sweepings can be lifted in a vertical direction, within the intake line.

Sweepers of the type specified at the outside are also known from EP 1 772 563 A1 and EP 1 772 564 B1. Both publications describe a sweeper, with which the sweepings are transferred from the suction port into the dirt container by means of a suction flow. Part of the suction air drawn in will, subsequently, again be directed onto the ground surface to be cleaned whereas the remaining suction air will be discharged to the surroundings by a suction unit.

The object of the invention is to further develop an automotive sweeper of the type described at the outset in such a manner that it achieves an improved cleaning result with as little use of energy as possible.

SUMMARY OF THE INVENTION

With an automotive sweeper of the generic type, this object is accomplished in accordance with the invention, in that the suction conduit is integrated into the dirt container at least in sections, wherein the outlet of the intake line which opens into the dirt container is arranged next to at least one inlet area of the suction conduit.

In the case of the sweeper according to the invention, the suction conduit is integrated into the dirt container at least in sections. This makes a particularly compact configuration of the suction conduit possible, which is also optimized with respect to flow, and so its flow resistance can be kept low. At least one inlet area of the suction conduit is arranged to the side next to the outlet of the intake line which opens into the dirt container. As a result, the suction air entering the dirt container can be separated particularly effectively within the dirt container from sweepings which have been carried along. The suction flow entering the dirt container via the rear line section and the outlet of the intake line preferably catapults the sweepings in the direction facing away from the front container wall of the dirt container. The sweepings can, therefore, be catapulted within the dirt container in the direction of its rear container wall—in relation to the direction of travel of the sweeper—and/or in the direction of its cover. The suction air can, instead, experience a deflection through 180° within the dirt container so that it can pass from the outlet of the intake line to the at least one inlet area of the suction conduit which is arranged next to the outlet of the intake line.

The arrangement of the outlet of the intake line to the side next to the at least one inlet area of the suction conduit results in the sweepings, which have been carried along, being separated from the suction flow and sinking in the dirt container. This allows an effective separation of the sweepings from the suction flow to be achieved without complicated filter devices with a high grade of filtration needing to be used for this purpose. Filter units of this type with a high grade of filtration represent a considerable flow resistance and make the use of a powerful suction turbine necessary. In contrast hereto, a filter unit with a high grade of filtration can be dispensed with on account of the effective separation of the sweepings from the suction flow on account of the arrangement of the at least one inlet area of the suction conduit to the side next to the outlet of the intake line. This, on the other hand, makes it possible to use a suction unit with a lower power input and, therefore, also with a lower energy consumption without the cleaning result being impaired thereby.

The outlet of the intake line and the at least one inlet area of the suction conduit are preferably arranged in the region of the front container wall of the dirt container. This allows the sweepings entering via the outlet of the intake line to be catapulted from the area of the front container wall as far as the rear container wall and, as a result, a particularly long separating path to be obtained, within which the suction air can be separated from the sweepings.

A rear line section of the intake line preferably passes through the suction conduit. This makes a particularly compact construction possible.

It is of particular advantage when the outlet of the intake line is arranged between inlet areas of the suction conduit. For example, it may be provided for an inlet area of the suction conduit to be arranged on each side of the outlet. This allows the dirt container to be acted upon with a vacuum via the suction conduit in a symmetrical manner with respect to the outlet, whereby the flow resistance of the suction conduit and, therefore, also the energy consumption of the suction unit can be kept particularly low.

A further inlet area of the suction conduit may be arranged above the outlet of the intake line.

It may be provided for a filter unit to be arranged at the at least one inlet area of the suction conduit. This can, however, be of a relatively simple design since an effective separation of the sweepings from the suction air will already be achieved on account of the arrangement of at least one inlet area of the suction conduit next to the outlet of the intake line. It may, for example, be provided for the filter unit to be formed by a screen or a grating with a relatively large permeability.

It is of advantage when the intake line has a front line section which connects the suction port to a rear line section of the intake line, is aligned at an angle to the vertical and extends in a straight line. The straight-line course of the front line section of the intake line reduces the flow resistance of the suction flow and so the energy consumption of the sweeper can be reduced further. The straight-line course of the front line section with an alignment at relative to the vertical also reduces the risk of any blockage of the intake line.

The front line section of the intake line is preferably configured in the form of a suction hose. As a result, the production costs of the sweeper can be kept low and also the assembly of the sweeper is simplified. The suction hose may have a form-stabilizing reinforcing element, for example a helical wire coil integrated into the suction hose.

It is of particular advantage when the front line section of the intake line is rotatable about its longitudinal axis relative to the rear line section of the intake line. The two line sections are not rigidly coupled to one another with such a configuration but they can rather be turned relative to one another about the longitudinal axis of the front line section. This brings about an additional simplification of the assembly of the sweeper and, in addition, results in the front line section being able to follow any steering movement of the sweeper in a simple manner.

A rotatable connection of the front line section to the rear line section is of advantage, in particular, when the sweeper has a chassis with a front and a rear chassis part which are connected to one another via a joint and the front line section of the intake line is connected to the front chassis part and the rear line section of the intake line is connected to the rear chassis part. The use of a chassis with two chassis parts which are articulatedly connected to one another improves the maneuverability of the sweeper; this may, in particular, have a relatively small turning radius. It is particularly well suited for sweeping confined ground surfaces, for example narrow parking lots. The front line section of the intake line may be secured to the front chassis part and the rear line section of the intake line may be secured to the rear chassis part. The rotatable connection of the two line sections ensures that the maneuverability of the sweeper is not impaired by the intake line.

It is favorable when the front line section is connected to an adapter—preferably arranged on the dirt container—with its rear end facing away from the suction port so as to be freely movable, the rear line section adjoining this adapter. The adapter can be configured, for example, in the form of a sleeve, in which the rear end of the front line section engages. It may also be provided for the adapter to be designed as a piece of pipe, onto which the rear end of the front line section is placed.

The rear end of the front line section is favorably adapted to be connected to the adapter without any tools and is rotatable relative to it about the longitudinal axis of the front line section. It may, for example, be provided for the adapter to be designed as a sleeve, into which the rear end of the front line section can be inserted without the use of a tool, wherein the rear end is rotatable relative to the sleeve. The rear end can be accommodated by the sleeve with clearance.

The suction unit of the sweeper is arranged beneath the dirt container in an advantageous embodiment of the invention. The point of gravity of the road sweeper can, as a result, be kept relatively low. This increases the stability of the sweeper against tilting over. In addition, the maneuverability of the sweeper is improved by a point of gravity which is as low-lying as possible.

It is favorable when the suction unit has a suction turbine, the axis of rotation of which is aligned vertically. The vertical alignment of the axis of rotation of the suction turbine reduces Coriolis forces when the sweeper is traveling through bends. The mechanical load on the bearing points of the suction turbine can be reduced as a result and this, on the other hand, brings about a longer service life of the sweeper.

The suction conduit is, in accordance with the invention, integrated into the dirt container at least in sections. In this respect, it is favorable when the area of the suction conduit integrated into the dirt container extends within the dirt container along its front container wall and along its bottom wall. The suction conduit is preferably rounded so that the suction flow is subjected to as low a flow resistance as possible.

In order to keep any formation of dust during sweeping of a ground surface as low as possible, it is of advantage when the sweeper has a water tank which is connected to nozzles which are arranged in the region of the at least one sweeping brush for the purpose of spraying water onto the ground surface to be swept. In one advantageous development of the invention, it is provided for the water tank to be of a trough-like design and form a receptacle on the upper side, in which the dirt container engages. The water tank therefore encloses at least a lower part of the dirt container at least over a section of its circumference. Preferably, the dirt container is completely surrounded by the water tank in its lower region. The water tank reduces the amount of noise caused by the sweeper.

The noise-reducing effect of the water tank is particularly great in one preferred configuration in that the water tank forms a receptacle on the underside which accommodates the suction turbine of the suction unit. The suction turbine is, therefore, surrounded by the water tank, which considerably dampens the noise generated by the suction turbine, on its upper side and at least over part of its circumference.

The receptacle of the water tank on the upper side is favorably connected to the receptacle on the underside via a passage.

The passage can form an end section of the suction conduit facing the suction unit. The inlet of the suction unit can adjoin this end section. The area of the suction conduit, which is integrated into the dirt container and can extend within the dirt container as far as the at least one inlet area, can adjoin the passage on the upper side. The suction conduit can, therefore, be defined by the dirt container and the passage of the water tank.

In one preferred embodiment, the air drawn in will be discharged by the suction turbine to a diffuser. This is preferably arranged on the outer side on the water tank or on the rear container wall of the dirt container. The diffuser causes a homogeneous distribution of air and ensures that the environment is affected as little as possible by the air discharged from the sweeper.

As already explained, it may be provided for a front line section of the connection line to be connected to the rear line section of the intake line via an adapter, for example a sleeve. The adapter is formed by the water tank in a preferred embodiment of the invention.

It may be provided, in particular, for the adapter is be designed as a tank area in the form of a double-walled sleeve which accommodates the rear end of the front line section, wherein the rear end can be inserted into the sleeve without the use of a tool. The rear line section of the intake line, which passes through the suction conduit, can adjoin the adapter in the direction of flow of the suction flow.

It is of particular advantage when the water tank is designed as a one-piece plastic molded part. This makes a further reduction in the production and assembly costs of the sweeper possible.

The dirt container is also preferably designed as a one-piece or multiple piece plastic molded part which is covered by one or several cover parts.

It may be provided for the dirt container to have a container lower part which is designed as a one-piece plastic molded part.

The dirt container is preferably pivotable about a horizontal pivot axis so that it can be tilted backwards for the purpose of emptying it.

It is particularly advantageous when the dirt container is mounted on the water tank so as to be pivotable about a horizontal pivot axis. It can, as a result, be pivoted outwards in a simple manner out of the receptacle of the water tank on the upper side for the purpose of emptying it.

It is of advantage when the dirt container, in combination with the water tank and the suction unit, forms a structural component in the form of a vehicle superstructure which can be placed onto a set-up surface of the sweeper and removed from it.

The vehicle superstructure can favorably be locked to the set-up surface.

The set-up surface can be formed, for example, from supporting rails, onto which the vehicle superstructure can be placed and along which the vehicle superstructure can be moved.

When the vehicle superstructure reaches its end position on the supporting rails, it can be locked automatically to the supporting rail in one preferred development.

The following description of one preferred embodiment of the invention serves to explain the invention in greater detail in conjunction with the drawings.

DETAILED DESCRIPTION OF THE INVENTION

Figure 1:
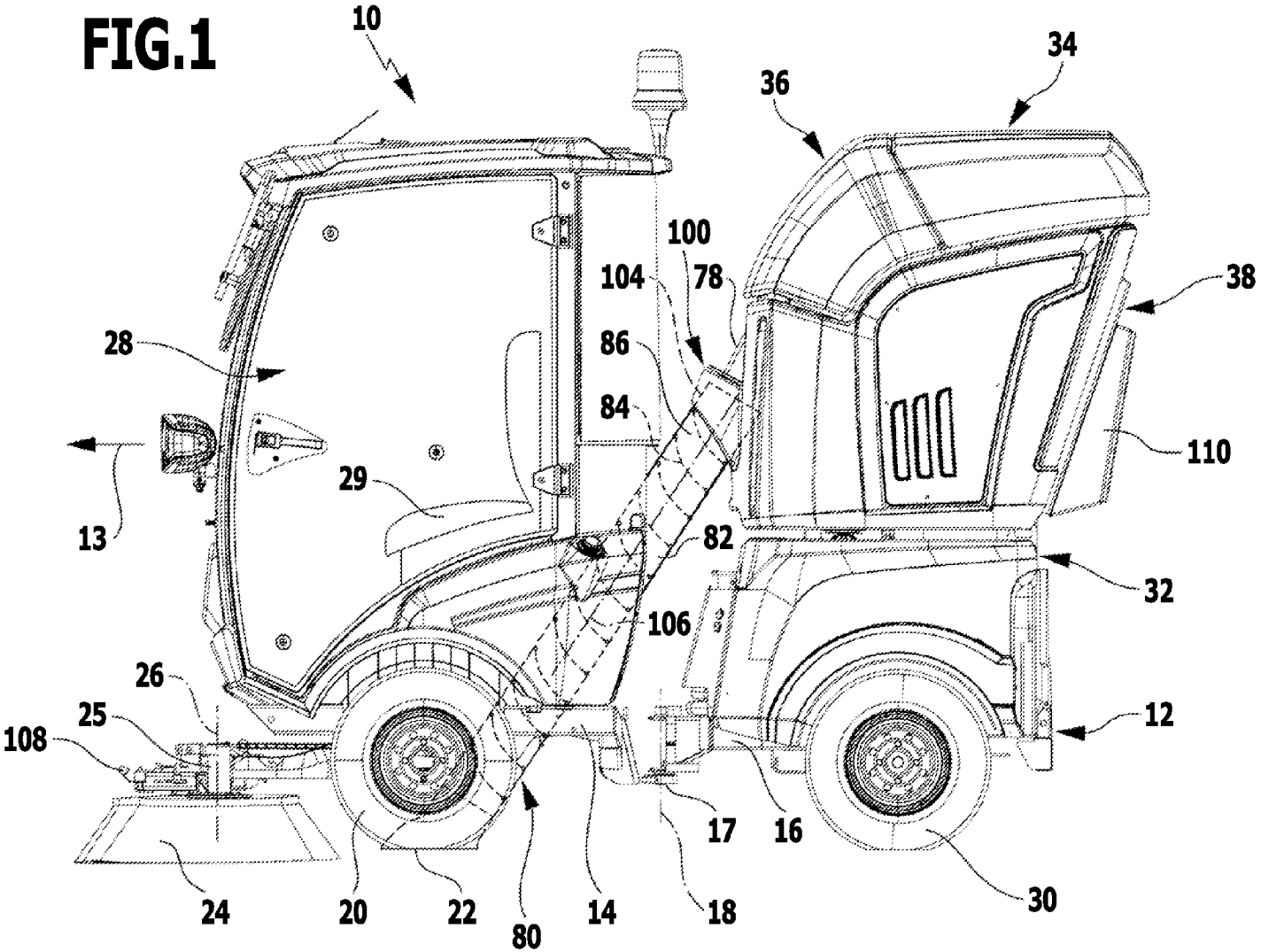
FIG. 1: a schematic side view of an automotive sweeper.
Figure 2:
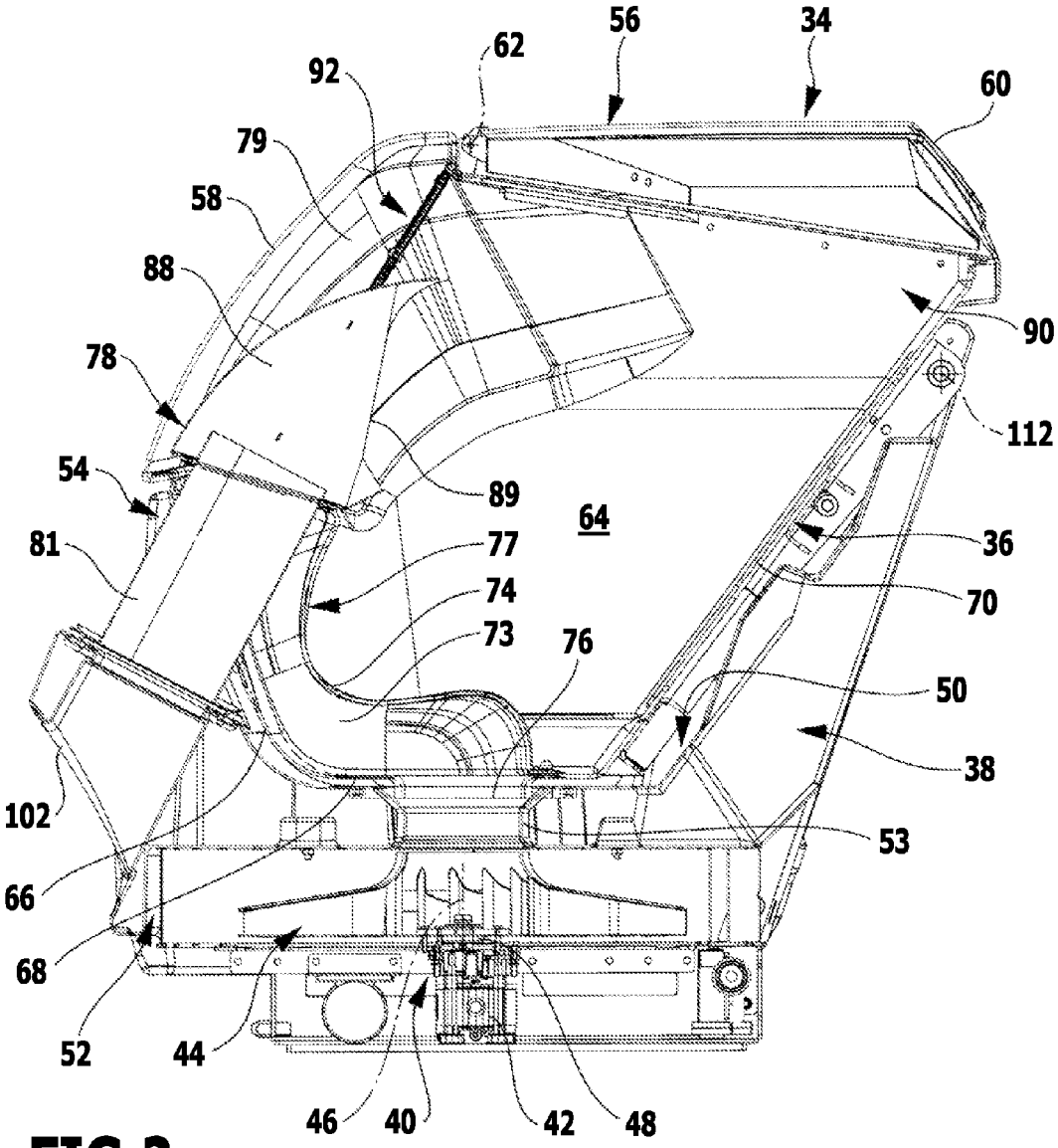
FIG. 2: a sectional view of a vehicle superstructure of the sweeper from FIG. 1 along the longitudinal axis of the vehicle with a dirt container, a water tank and a suction unit.

An automotive sweeper 10 is illustrated schematically in the drawings with a chassis 12 which has a chassis part 14 to the front in the direction of travel 13 and a chassis part 16 to the rear in the direction of travel 13. The two chassis parts 14 and 16 are connected to one another via a joint 17 so as to be pivotable about a vertical pivot axis 18.

Two steerable front wheels are rotatably mounted on the front chassis part 14, wherein only one front wheel 20 can be seen in the drawings. A suction port 22 is arranged between the two front wheels.

At least one plate-like sweeping brush 24 is mounted on the front chassis part 14 in front of the front wheels 20 in the direction of travel 13 and this sweeping brush can be caused to rotate about an axis of rotation 26, which is aligned almost vertically, by means of a brush motor 25. A ground surface, for example a street, a sidewalk or a parking lot, can be swept by means of the sweeping brush 24, wherein the sweepings are supplied to the suction port.

A driver's cab 28, in which a user of the sweeper 10 can take his place on a driver's seat 29, is arranged above the front chassis part 24.

Two rear wheels which can be rotated about a common axis of rotation are mounted on the rear chassis part 16, wherein only one rear wheel 30 can be seen in the drawings. The rear chassis part 16 bears a supporting part 32 with a set-up surface which bears a vehicle superstructure 34. The vehicle superstructure 34 is formed by a dirt container 36 in combination with a water tank 38 and a suction unit 40 which is arranged beneath the dirt container 36 and the water tank 38 and can be removed from the set-up surface as required.

The suction unit 40 comprises a drive motor 42 and a suction turbine 44 which can be caused to rotate about a turbine axis 46, which is aligned vertically, by the drive motor 42. The drive movement of the drive motor 42 is transferred to the suction turbine 44 via gearing 48.

The water tank 38 is designed as a one-piece, trough-like plastic molded part and has a receptacle 50 on the upper side and a receptacle 52 on the underside which are connected to one another via a passage 53. The receptacle 52 on the underside accommodates the suction turbine 44 which is covered by the water tank 38 and is surrounded in circumferential direction by the water tank 38 for the most part.

The dirt container 36 engages in the receptacle 50 of the water tank 38 on the upper side with a container lower part 54 which is designed as a one-piece plastic molded part and is covered by a two-piece container upper part 56. The upper part 56 of the container is formed by a front container cover 58 and a rear container cover 60. The front container cover 58 is releasably connected to the lower part 54 of the container; in the embodiment illustrated it is screwed to the lower part 54 of the container. The rear container cover 60 is articulatedly connected to the lower part 54 of the container and can be pivoted outwards about a horizontal pivot axis 62 in order to open up the interior space 64 of the container.

Figure 3:
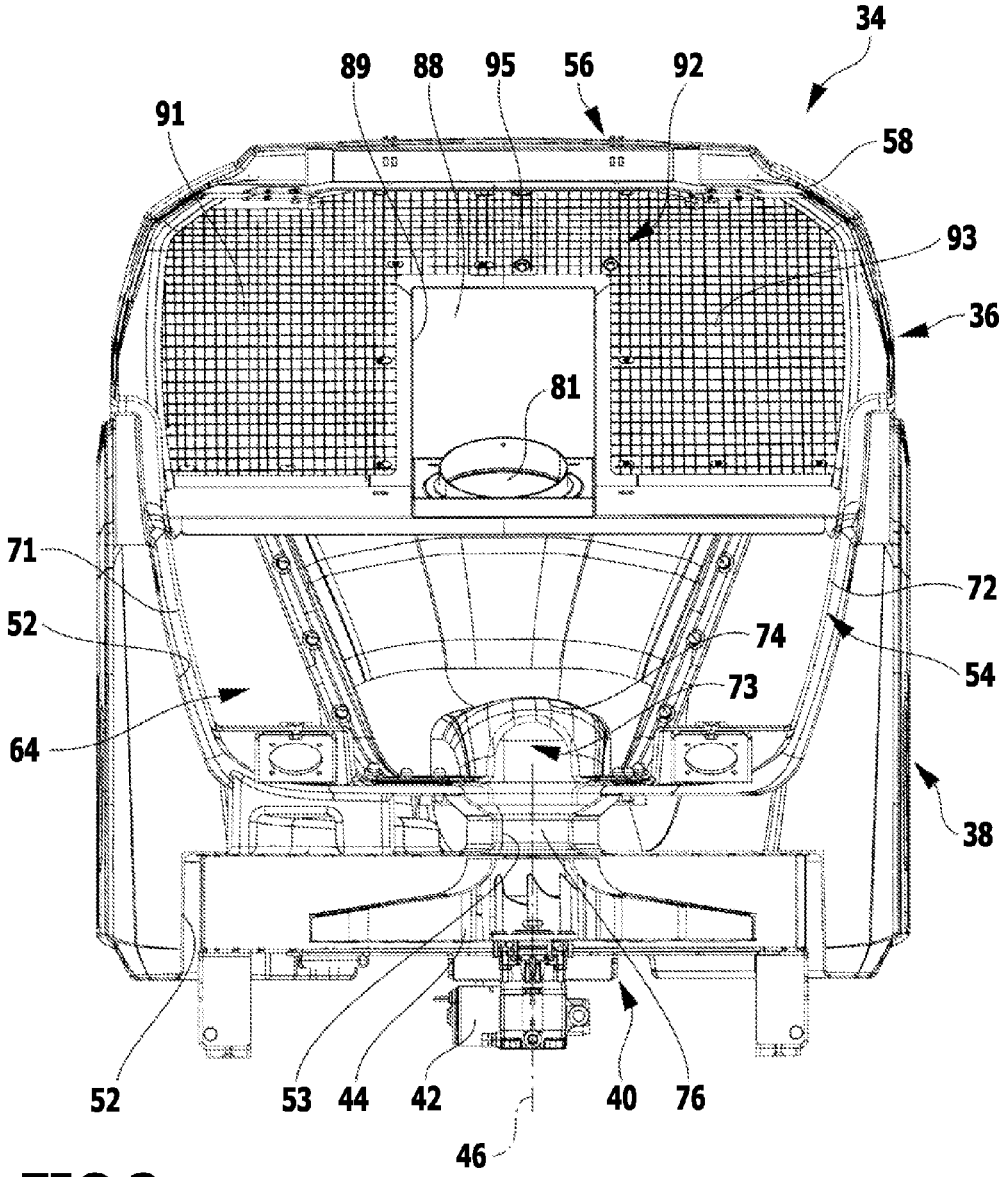
FIG. 3: a sectional view of the vehicle superstructure from FIG. 2 transversely to the longitudinal axis of the vehicle.

The lower part 54 of the container has a container wall 66 to the front—in relation to the direction of travel—, a bottom wall 68 and a rear container wall 70 as well as two side walls 71, 72. As is clear, in particular, from FIG. 3, a central section of the front container wall 66 and the bottom wall 68 is covered on the inner side by an arc-shaped conduit wall 74 which defines a central conduit section 73 of a suction conduit 77 in combination with the covered section of the front container wall 66 and the bottom wall 68. The central conduit section 73 is adjoined at the bottom wall 68 by the passage 53 which defines a rear conduit section 76 of the suction conduit 77 and on the inner side of the front container wall 66 the central conduit section 73 is adjoined by a front conduit section 79 of the suction conduit 77.

The central conduit section 73 and the front conduit section 79 of the suction conduit are integrated into the dirt container 36 and have a rear line section 78 of an intake line 80 passing through them which connects the suction port 22 to the interior space 64 of the container. The rear line section 78 is formed by a piece of pipe 81 and a manifold 88 adjoining the piece of pipe 81. The manifold 88 points in the direction towards the corner area 90 of the interior space 64 of the container between the rear container cover 60 and the rear container wall 70. Continuing from the rear line section 68, the intake line 80 comprises a straight-lined front line section 82 which is aligned at an angle to the vertical and is in the form of a flexible suction hose 86 which is reinforced by means of a wire coil 84 bent in a helical shape.

The manifold 88 passes through the front conduit section 79 of the suction conduit 77 and forms with its opening an outlet 89 of the intake line 80. An inlet area 91 and 93, respectively, of the suction conduit 77 is arranged on either side next to the outlet 89. An additional inlet area 95 of the suction conduit 77 is located above the outlet 89. This is clear from FIG. 3. The inlet areas 91, 93 and 95 are covered by a filter unit in the form of a screen 92 which is arranged between the lower part 54 of the container and the front container cover 58.

The front line section 82 of the intake line 80 which is designed as a suction hose 86 is connected to the rear line section 78 via an adapter 100. The adapter 100 is configured in the form of a double-walled sleeve 102 which is defined by the water tank 38. The rear end 104 of the suction hose 86 engages in the sleeve 102 in a rotatingly movable manner and can be turned about the longitudinal axis 106 of the suction hose 86 relative to the sleeve 102. The rotatingly movable connection of the front line section 82 via the sleeve 102 to the rear line section 78 makes it possible to turn the suction hose 86, which is connected to the front chassis part 14 of the chassis 12, about the longitudinal axis 106 during maneuvering of the sweeper 10.

The entire vehicle superstructure 34 can be removed from the supporting part 32 and placed on the supporting part 32 as required. The vehicle superstructure 34 can be locked to the supporting part 32 with the aid of a locking unit.

The water tank 38 is in flow communication with nozzles 108 which are held at the sweeping brush 24 via a water line which is known per se and not, therefore, illustrated in the drawings in order to achieve a better overview. Water can be pumped from the water tank 38 to the nozzles 108 by means of a water pump which is likewise not illustrated in the drawings. The water can be sprayed via the nozzles 108 onto the ground surface to be swept. As a result, any formation of dust during sweeping can be kept small.

During operation of the automotive sweeper 10, the interior space 64 of the dirt container 36 is acted upon with a vacuum by the suction unit 40. For this purpose, the suction unit 40 is in flow communication with the interior space 64 of the container via the rear conduit section 76, which is formed by the passage 53, the central conduit section 73 and the front conduit section 79 of the suction conduit 77. The interior space 64 of the container is, on the other hand, in flow communication with the suction port 22 via the manifold 88 and the piece of pipe 81 of the rear line section 78 and the front line section 82. As a result, a suction flow to the dirt container 36 can be achieved, proceeding from the suction port 22 via the intake line 80 and from the dirt container to the suction unit 40 via the suction conduit 77. The suction air can be discharged from the suction unit 40 to the surroundings via a diffuser 110 which is held on the vehicle superstructure 34 on the rear side.

Sweepings can be transferred from the suction port 22 to the dirt container 36 by means of the suction flow generated by the suction unit 40. The sweepings enter the interior space 64 of the container via the outlet 89 of the intake line 80 and will be catapulted by the suction flow into the corner area 90 between the rear container cover 60 and the rear container wall 70 whereas the suction air reverses its direction of flow in the interior space 64 of the container through 180° and, subsequently, enters the suction conduit 77 via the screen 92 and the inlet areas 91, 93 and 95 and from there passes to the suction unit 40 and, subsequently, to the diffuser 110.

The suction flow therefore experiences a deflection through 180° within the dirt container 36. This results in a particularly effective separation of the sweepings carried along. The sweepings pass into the lower area of the dirt container 36. This lower area is surrounded by the water tank 38 which forms a protection against noise and also covers the suction turbine 44 and surrounds it in circumferential direction for the most part. The water tank 38 also defines the sleeve 102, via which the rear line section 78 is connected to the front line section 82 of the intake line 80 so as to be rotatingly movable.

The dirt container 36 is held on the water tank 38 so as to be pivotable. For the purpose of emptying it, it can be tilted backwards relative to the water tank 38 about a horizontal pivot axis 112. Piston-cylinder units, which are known to the person skilled in the art and not illustrated in the drawings, can be used for this purpose. When the dirt container 36 is pivoted outwards, the rear line section 78 lifts away from the sleeve 102 which is formed by the water tank 38. When the dirt container 36 is pivoted inwards, the rear line section 78 again takes up its position abutting on the sleeve 102, in which it extends in alignment with the front line section 82.

An effective suction flow can be achieved by means of the suction unit 40 on account of the course of the intake line 80 which is optimized with respect to flow technology and the arrangement of the outlet 89 of the intake line 80 in the area of the front container wall 66 between the inlet areas 91, 93 and 95 of the suction conduit 77 and so sweepings can be taken up by the suction port 22 and transferred to the dirt container 36. The suction unit 40 can, in this respect, have a relatively low energy consumption.

The sweeper 10 has a relatively low-lying point of gravity on account of the arrangement of the suction unit 40 beneath the dirt container 36 and the arrangement of the water tank 38 between the dirt container 36 and the suction unit 40. The risk of the sweeper 10 tilting over on uneven surfaces can be kept very small as a result.

Since the turbine axis 46 of the suction unit 40 is of a vertical alignment, Coriolis forces can be kept small when the sweeper 10 is traveling along. This, on the other hand, makes it possible to reduce the mechanical load on the bearing points of the suction turbine 44.

The invention claimed is:

1. Automotive sweeper, comprising:

wheels for traveling along a ground surface, at least one sweeping brush rotatingly drivable for sweeping the ground surface, a dirt container adapted to be acted upon with a vacuum by a suction unit via a suction conduit and connected via an intake line to a suction port for receiving sweepings, and a water tank connected to nozzles arranged in a region of the at least one sweeping brush for spraying water onto the ground surface to be swept, wherein:

the suction conduit is integrated into the dirt container at least in sections, an outlet of the intake line opening into the dirt container is arranged next to at least one inlet area of the suction conduit, the water tank is of a trough-like design and forms a receptacle on an upper side, and the dirt container engages in said receptacle.

2. Automotive sweeper as defined in claim 1, wherein the outlet of the intake line and the at least one inlet area of the suction conduit are arranged in a region of a front container wall of the dirt container.

3. Automotive sweeper as defined in claim 1, wherein a rear line section of the intake line passes through the suction conduit.

4. Automotive sweeper as defined in claim 1, wherein the outlet of the intake line is arranged between inlet areas of the suction conduit.

5. Automotive sweeper as defined in claim 1, wherein the intake line has a front line section connecting the suction port to a rear line section of the intake line, said front line section being aligned at an angle to vertical and extending in a straight line.

6. Automotive sweeper as defined in claim 5, wherein the front line section is designed as a flexible suction hose.

7. Automotive sweeper as defined in claim 5, wherein the front line section has a longitudinal axis and is rotatable about the longitudinal axis relative to the rear line section.

8. Automotive sweeper as defined in claim 7, further comprising:

a chassis with a front chassis part and a rear chassis part connected to one another via a joint, wherein the front line section of the intake line is connected to the front chassis part and the rear line section of the intake line is connected to the rear chassis part.

9. Automotive sweeper as defined in claim 5, wherein the front line section is connected with a rear end of the front line section facing away from the suction port to an adapter adjoined by the rear line section.

10. Automotive sweeper as defined in claim 9, wherein the rear end of the front line section is adapted to be connected to the adapter without tools and is rotatable relative to it.

11. Automotive sweeper as defined in claim 1, wherein the suction unit is arranged beneath the dirt container.

12. Automotive sweeper as defined in claim 1, wherein the suction unit has a suction turbine, an axis of rotation of the suction turbine being aligned vertically.

13. Automotive sweeper as defined in claim 1, wherein the sections of the suction conduit integrated into the dirt container extend within the dirt container along a front container wall and along a bottom wall.

14. Automotive sweeper as defined in claim 1, wherein the water tank forms a receptacle on an underside accommodating a suction turbine of the suction unit.

15. Automotive sweeper as defined in claim 14, wherein the receptacle on the upper side is connected to the receptacle on the underside via a passage.

16. Automotive sweeper as defined in claim 15, wherein the passage forms an end area of the suction conduit facing the suction unit.

17. Automotive sweeper as defined in claim 1, wherein the water tank forms an adapter connecting a front line section of the intake line to a rear line section of the intake line.

18. Automotive sweeper as defined in claim 17, wherein the adapter is designed as a sleeve, an end of the front line section facing away from the suction port engaging in said sleeve.

19. Automotive sweeper as defined in claim 1, wherein the water tank comprises a one-piece plastic molded part.

20. Automotive sweeper as defined in claim 1, wherein the dirt container has a container lower part comprising a one-piece plastic molded part.

21. Automotive sweeper as defined in claim 1, wherein the dirt container is mounted on the water tank so as to be pivotable about a horizontal pivot axis.

* * * * *